US009121274B2

(12) United States Patent
Nevin

(10) Patent No.: US 9,121,274 B2
(45) **Date of Patent: *Sep. 1, 2015**

(54) METHOD FOR REMOVING CONTAMINANTS FROM WASTEWATER IN HYDRAULIC FRACTURING PROCESS

(71) Applicant: Donald Nevin, Woodbury, NY (US)

(72) Inventor: Donald Nevin, Woodbury, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/550,060

(22) Filed: Nov. 21, 2014

(65) Prior Publication Data

US 2015/0096749 A1 Apr. 9, 2015

Related U.S. Application Data

(63) Continuation of application No. 14/227,498, filed on Mar. 27, 2014, now Pat. No. 8,899,325, which is a continuation-in-part of application No. 13/786,120, filed on Mar. 5, 2013, now Pat. No. 8,746,335, which (Continued)

(51) Int. Cl.

| | |
|---|---|
| ***E21B 43/16*** | (2006.01) |
| ***E21B 43/267*** | (2006.01) |
| ***E21B 43/38*** | (2006.01) |
| ***E21B 43/02*** | (2006.01) |
| ***E21B 37/00*** | (2006.01) |

(52) U.S. Cl.

CPC ..... *E21B 43/38* (2013.01); *E21B 37/00* (2013.01); *E21B 43/02* (2013.01); *E21B 43/168* (2013.01); *E21B 43/267* (2013.01)

(58) Field of Classification Search

CPC ..... E21B 43/267; E21B 43/26; E21B 43/02; E21B 43/168; E21B 43/38; E21B 43/04; E21B 43/34; E21B 37/00; C09K 8/805

USPC ..... 166/244.1, 280.1, 308.1, 265, 278, 279, 166/308.2, 227, 242.1

See application file for complete search history.

(56) References Cited

U.S. PATENT DOCUMENTS

| | | | |
|---|---|---|---|
| 5,256,729 | A | 10/1993 | Kutta et al. |
| 5,466,093 | A | 11/1995 | Keller |
| 5,641,020 | A | 6/1997 | Cherry et al. |
| 6,447,577 | B1 | 9/2002 | Espin et al. |
| 7,896,578 | B2 | 3/2011 | Keller |
| 8,267,176 | B2 | 9/2012 | Nguyen et al. |

(Continued)

FOREIGN PATENT DOCUMENTS

| | | | |
|---|---|---|---|
| EP | 0308257 | A2 | 3/1989 |
| WO | WO 2013-002826 | A1 | 1/2013 |

*Primary Examiner* — Daniel P Stephenson

(74) *Attorney, Agent, or Firm* — Epstein Drangel LLP; Robert L. Epstein

(57) ABSTRACT

A borehole is drilled from the surface to an underground shale matrix. A pipe is inserted into the borehole. Openings are created in the pipe in fluid communication with fractures in the shale matrix. The interior surface of at least one section of pipe is coated with a contaminant-capturing substance. Fracturing fluid including water, proppants and chemicals is pumped through the pipe and into the fractures in the shale matrix. The fluid re-enters the pipe from the shale matrix and moves toward the surface through the coated pipe section where contaminants are sequestered by the coating. Natural gas or oil from the fractured shale then enters the pipe and moves to the surface to be collected. The coated pipe section remains in the ground permanently such that the necessity of disposing of the captured contaminants is eliminated.

15 Claims, 7 Drawing Sheets

Related U.S. Application Data is a continuation-in-part of application No. 13/170,664, filed on Jun. 28, 2011, now Pat. No. 8,726,989.

(60) Provisional application No. 61/399,495, filed on Jul. 14, 2010, provisional application No. 61/516,409, filed on Apr. 4, 2011, provisional application No. 61/690,317, filed on Jun. 25, 2012, provisional application No. 61/795,175, filed on Oct. 12, 2012.

(56) References Cited

U.S. PATENT DOCUMENTS

| | | | | |
|---|---|---|---|---|
| 8,567,502 | B2 | 10/2013 | O'Malley et al. | |
| 8,726,989 | B2 | 5/2014 | Nevin | |
| 2008/0227666 | A1 | 9/2008 | Randal et al. | |
| 2009/0107673 | A1 | 4/2009 | Huang et al. | |
| 2010/0282460 | A1 | 11/2010 | Stone et al. | |
| 2010/0311618 | A1 | 12/2010 | Rey et al. | |
| 2010/0319913 | A1 | 12/2010 | Post et al. | |
| 2011/0041924 | A1 | 2/2011 | Mohan et al. | |
| 2011/0162837 | A1 | 7/2011 | O'Malley et al. | |
| 2011/0244125 | A1 | 10/2011 | Weisenberg et al. | |
| 2012/0012307 | A1 | 1/2012 | Nevin | |
| 2012/0027157 | A1 | 2/2012 | Kuczynski et al. | |
| 2012/0067568 | A1 | 3/2012 | Palmer et al. | |
| 2012/0138295 | A1 | 6/2012 | Novotny | |
| 2012/0322696 | A1 | 12/2012 | Hayes et al. | |
| 2013/0056204 | A1* | 3/2013 | McDaniel et al. | 166/280.1 |
| 2013/0065800 | A1 | 3/2013 | McDaniel et al. | |
| 2013/0130948 | A1 | 5/2013 | Crews | |
| 2013/0168095 | A1 | 7/2013 | Loveless et al. | |
| 2013/0180714 | A1 | 7/2013 | Nevin | |
| 2013/0180720 | A1 | 7/2013 | Al-Dahlan et al. | |
| 2013/0206398 | A1 | 8/2013 | Tufano et al. | |

* cited by examiner

METHOD FOR REMOVING CONTAMINANTS FROM WASTEWATER IN HYDRAULIC FRACTURING PROCESS

CROSS-REFERENCE TO RELATED APPLICATIONS

This application is a continuation of application Ser. No. 14/227,498, filed Mar. 27, 2014, which is a continuation of application Ser. No. 13/786,120, filed Mar. 5, 2013, which is a continuation-in-part of application Ser. No. 13/170,664, filed Jun. 28, 2011. Application Ser. No. 13/170,664, filed Jun. 28, 2011, claims priority on Provisional Patent Application No. 61/399,495, filed Jul. 14, 2010, entitled "Method of Removing Radioactive and Other Contaminants From Frac Water in Gas Drilling" and on Provisional Patent Application No. 61/516,409, filed Apr. 4, 2011, entitled "Method of Removing Radioactive and Other Contaminants From Hydraulic Fracturing Flowback Water in Gas Drilling and related Technology." Further, application Ser. No. 13/786,120, filed Mar. 5, 2013 claims priority on Provisional Patent Application No. 61/690,317, filed Jun. 25, 2012, entitled "Banded Proppant Beads for Selective Sequestration of Well Drilling Contaminants" and on Provisional Application No. 61/795,175, filed Oct. 12, 2012, entitled "Subsurface Sequestration of Selected Contaminants Including Radionuclides in High Volume Hydraulic Fracturing."

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to the process of the recovery of underground natural gas and oil by hydraulic fracturing and more particularly to a method for removing contaminants from the wastewater produced by the hydraulic fracturing process.

2. Description of Prior Art Including Information Disclosed Under 37 CFR 1.97 and 1.98

High-volume horizontal hydraulic fracturing, also known as "hydrofracking," is a well-known drilling process for extracting natural gas and oil from underground shale rock deposits. The hydrofracking process includes injecting substantial quantities of a fracturing fluid consisting of water, mixed with sand or other base particles (known as "proppants") and other chemicals into the shale formations at high pressures to create, expand or extend fissures by breaking up the rock in order to release the gas or oil deposits captured in the shale matrix. The pressure in the rock and pumps cause the fracturing fluid to flow back through the well to the surface where it is collected. Then, the natural gas or oil can flow from the fractured shale deposit back through the pipe and be collected at the surface.

While the hydrofracturing process is very good at releasing natural gas and oil deposits that otherwise would be uneconomical to recover from the shale formulations, the disposal of the wastewater used in the process creates serious environmental issues because it is contaminated with various chemicals, some of which are toxic, as well as radioactive substances including radium and other radionuclides. As a result, the Environmental Protection Agency and other governmental agencies have become involved in monitoring the hydrofracking processes being carried out because the resulting wastewater often ends up in the water supply without appropriate treatment. That is a result of the wastewater either being processed in sewerage processing plants not designed to treat water with those types of contaminants or having no treatment at all. The wastewater may eventually be released into rivers that supply drinking water to the public. It may also end up in aquifers, surface ponds and lakes or be sent to injection wells for disposal.

The present invention relates a simple method of safely and economically removing contaminants from the wastewater resulting from the hydrofracking process. The invention has the advantage of not requiring the disposal of the removed contaminants, which may be toxic, radioactive or both, because the removed contaminants remain underground permanently. The contaminants are either captured in the coating of the proppants which are permanently lodged in the fractured shale deposits or are captured in the coating of the surface of the pipe in the borehole which remains in place in the ground after the gas or oil removal process is completed.

It is therefore a prime object of the present invention to provide a method of recovery of underground natural gas and oil by hydraulic fracturing.

It is another object of the present invention to provide a method of hydraulic fracturing in which contaminants are removed from the wastewater before the wastewater returns to the surface.

It is another object of the present invention to provide a method of hydraulic fracturing in which contaminants are removed from wastewater utilizing a contaminant-capturing substance which is situated and remains below the surface of the ground.

It is another object of the present invention to provide a method of hydraulic fracturing in which contaminants are removed from wastewater utilizing a contaminant-capturing substance which can be deposited in the pipe either before or after the pipe is placed in the ground.

It is another object of the present invention to provide a method of hydraulic fracturing in which contaminants are removed from wastewater utilizing a pipe with one or more sections coated with a contaminant-capturing substance.

It is another object of the present invention to provide a method of hydraulic fracturing in which contaminants are removed from wastewater utilizing a pipe with sections coated with different contaminant-capturing substances.

It is another object of the present invention to provide a method of hydraulic fracturing in which contaminants are removed from wastewater utilizing a pipe with spaced sections coated with the same or different contaminant-capturing substances.

It is another object of the present invention to provide a method of hydraulic fracturing in which contaminants are removed from wastewater utilizing a coated portion of the pipe.

It is another object of the present invention to provide a method of hydraulic fracturing in which contaminants are removed from wastewater utilizing a pipe with a liner containing a contaminant-capturing substance.

It is another object of the present invention to provide a method of hydraulic fracturing in which contaminants are removed from wastewater utilizing a pipe that is coated with multiple layers of a contaminant-capturing substance.

It is another object of the present invention to provide a method of hydraulic fracturing in which contaminants are removed from wastewater utilizing a pipe having a coating of contaminant-capturing substance sprayed on the interior surface of the pipe.

It is another object of the present invention to provide a method of hydraulic fracturing in which contaminants are removed from wastewater utilizing a contaminant-capturing substance coated on the interior surface of the pipe having a layer which increases the surface area of the pipe surface.

It is another object of the present invention to provide a method of hydraulic fracturing in which contaminants are removed from wastewater utilizing a contaminant-capturing substance coated pipe in which turbulence in the wastewater is created.

It is another object of the present invention to provide a method of hydraulic fracturing in which contaminants are removed from wastewater utilizing a customized mixture of contaminant-capturing substances.

It is another object of the present invention to provide a method of hydraulic fracturing in which contaminants are removed from wastewater utilizing proppants coated with a contaminant-capturing substance.

It is another object of the present invention to provide a method of hydraulic fracturing in which contaminants are removed from wastewater utilizing layers of proppants coated with different contaminant-capturing substances.

It is another object of the present invention to provide a method of hydraulic fracturing in which contaminants are removed from wastewater utilizing layers of proppants, wherein the proppants in at least one of the layers are not coated with a contaminant-capturing substance, and the proppants in another layer are coated with a contaminant-capturing substance.

It is another object of the present invention to provide a method of hydraulic fracturing in which contaminants are removed from wastewater utilizing proppants and ion exchange resins or other sequestering agents, either intermixed or in layers.

It is another object of the present invention to provide a method of hydraulic fracturing in which contaminants are removed from wastewater utilizing pipes coated with a contaminant-capturing substance wherein compressed air or other gas is used to create bubbles to prevent the build-up of dissolved solids over the coating which reduce the contaminant-capturing ability of the substance.

BRIEF SUMMARY OF THE INVENTION

In accordance with one aspect of the present invention, a method is provided for removing contaminants from wastewater in a hydraulic fracturing process. The method of the present invention begins by drilling a borehole from the surface into the shale matrix. A pipe is then inserted into the borehole and fractures are created in the shale matrix. The interior surface of at least one section of the pipe is coated with a contaminant-capturing substance. Fracturing fluid is pumped into the shale matrix to widen the fractures created in the shale. The wastewater in the shale re-enters the pipe from the shale and move through the coated pipe section, where the contaminants are sequestered in the coating, and then to the surface. Natural gas or oil from the fractured shale then enters the pipe and moves to the surface to be collected. The coated pipe section, with the contaminants, remains in the borehole.

The step of coating the interior surface of at least one section of the pipe includes depositing the coating prior to or after inserting the pipe into the borehole.

The method includes the step of coating the interior surface of a second section of the pipe with a contaminant-capturing substance. The second section of the pipe may be coated with the same or a different contaminant-capturing substance than the contaminant-capturing substance coated on the interior surface of the first section of the pipe. Further, the second coated section of the pipe may be adjacent to or spaced from the first coated section of the pipe.

The borehole has a vertical portion and usually has a horizontal portion. At least one coated section of the pipe is situated in the borehole. The coated section of the pipe is preferably in the vertical portion of the borehole. However, in some situations, the coated section of the pipe may be in the horizontal portion of the borehole or coated sections may be situated in each portion of the borehole.

The method also includes the step of increasing the surface area of the interior surface of the pipe section prior to coating. This can be achieved by depositing on the interior surface of the pipe section a material selected from the following group: nanotubes, nanostructures, roughened matrices, mesh and zeolite.

The contaminants which are captured by the coated section of the pipe include radionuclides. The step of coating the interior of a section of the pipe includes coating the interior of the pipe section with a radionuclide-capturing substance.

The step of coating the interior surface of a section of the pipe may be achieved by inserting a liner containing a contaminant-capturing substance into the pipe.

The step of coating the interior surface of a section of the pipe further includes coating the interior surface of the pipe section with a second coating of a contaminant-capturing substance. The second coating would be deposited over the first coating in the event that the first coating was no longer capable of capturing the contaminants, was worn off or otherwise corrupted. The second coating could be the same substance or a different substance than the first coating.

The step of coating the interior surface of a pipe section could be achieved by depositing or spraying a contaminant-capturing substance onto the interior surface of the pipe section. The substance could be a resin impregnated with the contaminant-capturing substance.

The method further includes the step of creating turbulence within the wastewater as the wastewater moves through the coated pipe section.

In accordance with another aspect of the present invention, a method is provided for removing contaminants from wastewater in a hydraulic fracturing process. The method of the present invention begins by drilling a borehole from the surface to the gas containing shale matrix. A pipe is then inserted into the borehole. Fracturing fluid containing proppants is formed and pumped under pressure into the shale matrix to widen the fractures in the shale. The proppants lodge in the shale fractures and remain there to keep the fractures open. The exterior surfaces of the proppants are coated with a contaminant-capturing substance. The wastewater re-enters the pipe from the shale matrix and moves through the pipe to the surface. The natural gas or oil from the fractured shale enters the pipe and moves to the surface to be collected.

The method also includes forming fracturing fluid including proppants coated with a different contaminant-capturing substance and pumping the fracturing fluid including proppants coated with a different contaminant-capturing substance through the pipe and into the shale matrix.

In accordance with another aspect of the present invention, a method is provided for removing contaminants from wastewater in a hydraulic fracturing process. The method begins by drilling a borehole from the surface to the underground shale matrix containing gas or oil. A pipe is inserted into the borehole. Openings in the pipe in fluid communication with fractures in the shale matrix are created. Fracturing fluid is prepared including proppants coated with a first substance. The fracturing fluid including proppants coated with the first substance is pumped through the pipe and into the shale matrix such that the proppants coated with the first substance lodge in the fractures in the shale. A fracturing fluid including proppants coated with a contaminant-capturing substance is prepared. The fracturing fluid containing proppants coated with the contaminant-capturing substance is pumped through the pipe and into the shale matrix. The fluid is allowed to re-enter the pipe from the shale matrix and move through the pipe to the surface. The gas or oil from the fractured shale is allowed to enter the pipe and move to the surface to be collected.

The first substance may include a non-contaminant-capturing substance such as phenolic resin or may be a contaminant-capturing substance such as an ion exchange resin.

The contaminant-capturing substance may include a barium or radium sequestering substance.

The method may further include forming fracturing fluid including proppants coated with a different contaminant-capturing substance and pumping the fracturing fluid containing proppants coated with the different contaminant-capturing substance through the pipe and into the shale matrix.

The different contaminant-capturing substance may include a barium or radium sequestering substance.

In accordance with another aspect of the present invention, a method is provided for removing contaminants from wastewater in a hydraulic fracturing process. The method begins by drilling a borehole from the surface to the underground shale matrix containing gas or oil. A pipe is inserted into the borehole. Openings in the pipe in fluid communication with fractures in the shale matrix are created. Fracturing fluid including proppants not coated with a contaminant-capturing substance is prepared. The fracturing fluid containing proppants not coated with a contaminant-capturing substance is pumped through the pipe and into the shale matrix such that the uncoated proppants lodge in the fractures in the shale. Proppants coated with a contaminant-capturing substance are formed. The proppants coated with the contaminant-capturing substance are pumped through the pipe and into the shale matrix. The fluid is allowed to re-enter the pipe from the shale matrix and move through the pipe to the surface. The gas or oil from the fractured shale is allowed to enter the pipe and move to the surface to be collected.

The proppants not coated with a contaminant-capturing substance may be uncoated or may be coated with phenolic resin or other material.

The contaminant-capturing substance may include a barium or radium sequestering substance.

The method further includes forming proppants coated with a different contaminant-capturing substance and pumping the proppants coated with the different contaminant-capturing substance through the pipe and into the shale matrix.

The different contaminant-capturing substance may include a barium or a radium sequestering substance.

The method may also include forming proppants coated with a third contaminant-capturing substance and pumping the proppants coated with the third contaminant-capturing substance through the pipe and into the shale matrix.

In accordance with another aspect of the present invention, a method is provided for removing contaminants from wastewater in a hydraulic fracturing process. The method begins by drilling a borehole from the surface to the underground shale matrix containing gas or oil. A pipe is inserted into the borehole. Openings are created in the pipe in fluid communication with fractures in the shale matrix. Fracturing fluids are formed, each including proppants of a different type. Each of the fluids containing proppants of a different type is pumped, in sequence, through the pipe and into the shale matrix such that the proppants of different types lodge in the fractures in the shale in layers. The fluid is allowed to re-enter the pipe from the shale matrix and move through the pipe to the surface. The gas or oil from the fractured shale is allowed to enter the pipe and move to the surface to be collected.

One of the proppant types may be uncoated. One of the proppant types may be coated with a substance other than a contaminant-capturing substance, such as a phenolic resin. One of the proppant types may be coated with a contaminant-capturing substance.

One of the proppant types may include proppants coated with a contaminant-capturing substance and another of the proppant types may include proppants coated with a different contaminant-capturing substance. Additional proppant types coated with additional or different contaminant-capturing substances may also be employed.

The contaminant-capturing substance may be a barium or a radium sequestering substance. The different contaminant-capturing substance may be a barium or a radium sequestering substance.

In accordance with another aspect of the present invention, a method is provided for removing contaminants from wastewater in a hydraulic fracturing process. The method begins by drilling a borehole from the surface to the underground shale matrix containing gas or oil. A pipe is inserted into the borehole. Openings in the pipe in fluid communication with fractures in the shale matrix are created. Fracturing fluid including proppants is formed. The fracturing fluid containing the proppants is pumped through the pipe and into the shale matrix such that the proppants lodge in the shale matrix. A contaminant-capturing substance is pumped through the pipe and into the shale matrix. The fluid is allowed to re-enter the pipe from the shale matrix and move through the pipe to the surface. The gas or oil from the fractured shale is allowed to enter the pipe and move to the surface to be collected.

The method further includes pumping fluid containing the proppants through the pipe and into the shale matrix a second time, after the contaminant-capturing substance is pumped through the pipe and into the shale matrix.

The proppants may be coated or uncoated. The coating may be a contaminant-capturing substance, such as an ion exchange resin, or a non-contaminant-capturing substance, such as an ion exchange resin.

In accordance with another aspect of the present invention, a method is provided for removing contaminants from wastewater in a hydraulic fracturing process. The method begins by drilling a borehole from the surface to the underground shale matrix containing gas or oil. A pipe is inserted into the borehole. Openings in the pipe in fluid communication with fractures in the shale matrix are created. Fracturing fluid including proppants and a contaminant-capturing substance is formed. The fracturing fluid containing the proppants and a contaminant-capturing substance is pumped through the pipe and into the shale matrix. The fluid is allowed to re-enter the pipe from the shale matrix and move through the pipe to the surface. The gas or oil from the fractured shale is allowed to enter the pipe and move to the surface to be collected.

The proppants may be uncoated or coated. The coating may be a contaminant-capturing substance, such as an ion exchange resin, or a non-contaminant-capturing substance, such as an ion exchange resin.

The contaminant-capturing substance may include a barium sequestering substance or a radium sequestering substance.

In accordance with another aspect of the present invention, a method is provided for removing contaminants from wastewater in a hydraulic fracturing process. The method begins with drilling a borehole from the surface to the underground shale matrix containing gas or oil. A pipe is inserted into the borehole. Openings are created in the pipe in fluid communication with fractures in the shale matrix. Fracturing fluid including a contaminant-capturing substance is formed. The fracturing fluid containing the contaminant-capturing substance is pumped through the pipe and into the shale matrix and may become coated with solids. Compressed gas is then pumped into the pipe to create bubbles to remove solids coating the contaminant-capturing substance. The fluid is allowed to re-enter the pipe from the shale matrix and move through the pipe to the surface. The gas or oil from the fractured shale is allowed to enter the pipe and move to the surface to be collected.

The contaminant-capturing substance in the fracturing fluid may adhere to the pipe or the fracturing fluid may include proppants coated with the contaminant-capturing substance.

In accordance with another aspect of the present invention, including for applications other than hydrofracking, for example for removing contaminants from the fluid in the cooling system of a nuclear reactor, a method is provided for removing contaminants from fluid flowing through a pipe. The method includes the steps of: coating the interior surface of at least one section of the pipe with a contaminant-capturing substance; allowing contaminated fluid to move through the coated pipe section; and periodically replacing the coated pipe section.

BRIEF DESCRIPTION OF THE SEVERAL VIEWS OF DRAWINGS

To these and to such other objects that may hereinafter appear, the present invention relates primarily to a method for removing contaminants from wastewater in a hydraulic fracturing process, and secondarily to a method for removing contaminants from other types of systems using pipes coated with contaminant-capturing substances, as described in detail in the following specification and recited in the annexed claims, taken together with the accompanying drawings, in which like numerals refer to like parts and in which:

Figure 9:
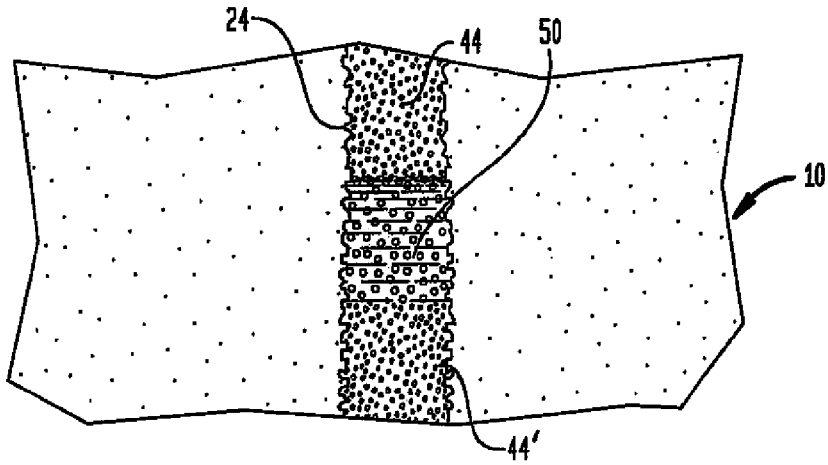
Figure 10:
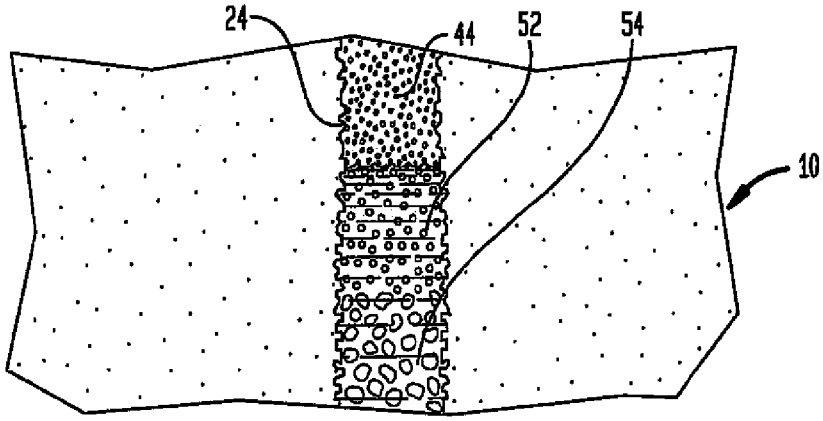

FIG. 9 is a cross-sectional view of a section of shale matrix located above a horizontal section of the pipe having a fracture into which a first layer of proppants, a second layer formed of a mixture of proppants and a contaminant-capturing liquid, and a third layer of proppants, have lodged; and FIG. 10 is a cross-sectional view of a section of shale matrix located above a horizontal section of the pipe having a fracture showing a first layer of proppants, a second layer including a sequestering material, alone or mixed with proppants, and a third layer including a different sequestering material, alone or mixed with proppants, have lodged.

DETAILED DESCRIPTION OF THE INVENTION

Figure 1:
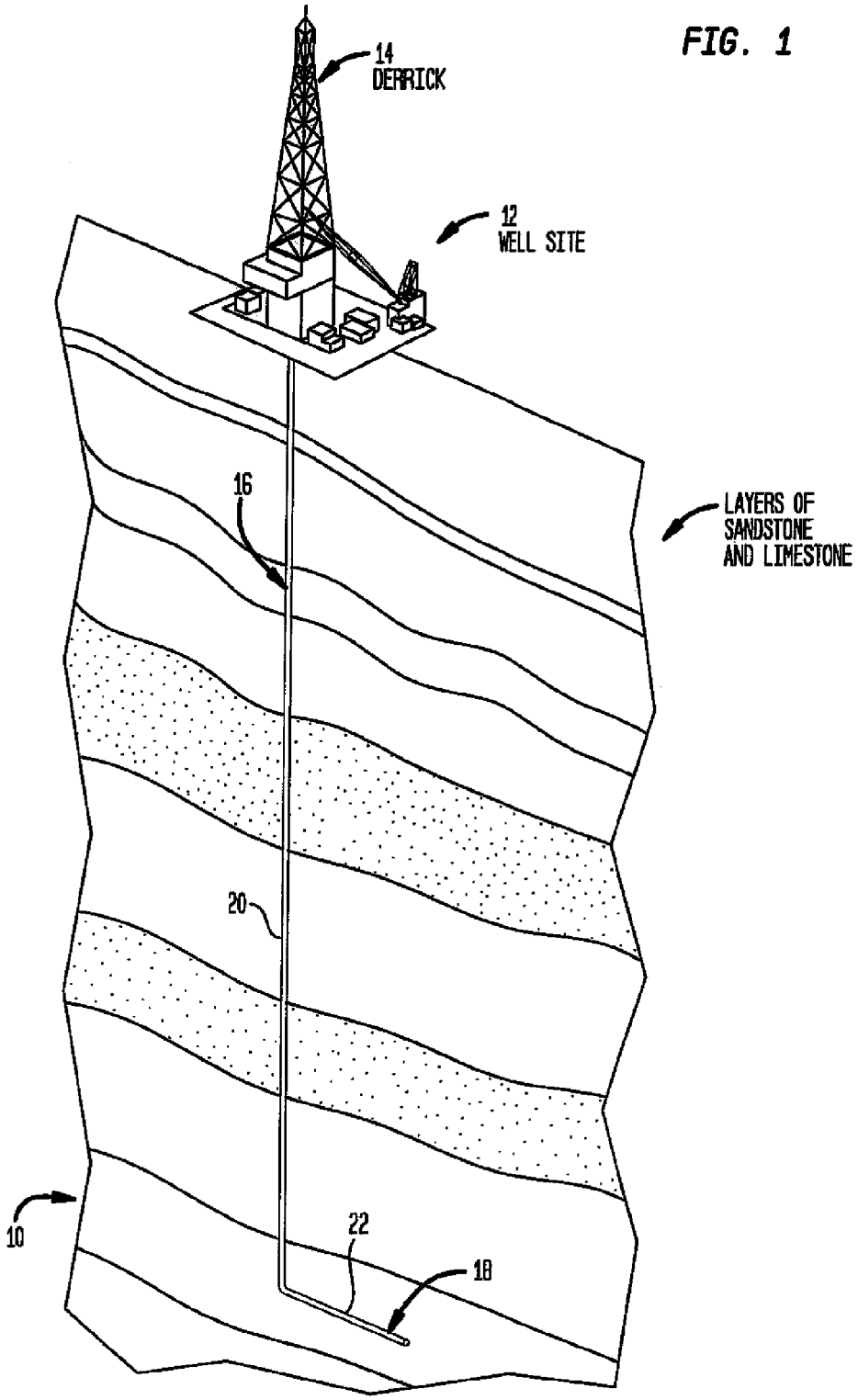
FIG. 1 is an idealized image showing a hydrofracturing well site with an underground borehole and pipe.

The process of natural gas or oil recovery from underground shale deposits by hydraulic fracturing begins by drilling the borehole which includes a vertical portion and a horizontal portion. As illustrated in FIG. 1, after the land above the shale formation 10 is cleared to create the well site 12, a temporary drilling rig or derrick 14 is erected on the surface of the ground above the shale deposit. A vertical well section 16 is drilled through the water table and into shale matrix 10, usually several thousand feet below the ground surface. A cement layer (not shown) may be used to seal the vertical portion of the borehole from the ground water.

The drill bit is angled to create the horizontal section 18 of the bore which extends though shale formation 10 for several thousand feet. Sections of pipe 20 are situated in the vertical well section 16. Sections of pipe 22 are situated in horizontal well section 18.

Figure 2:
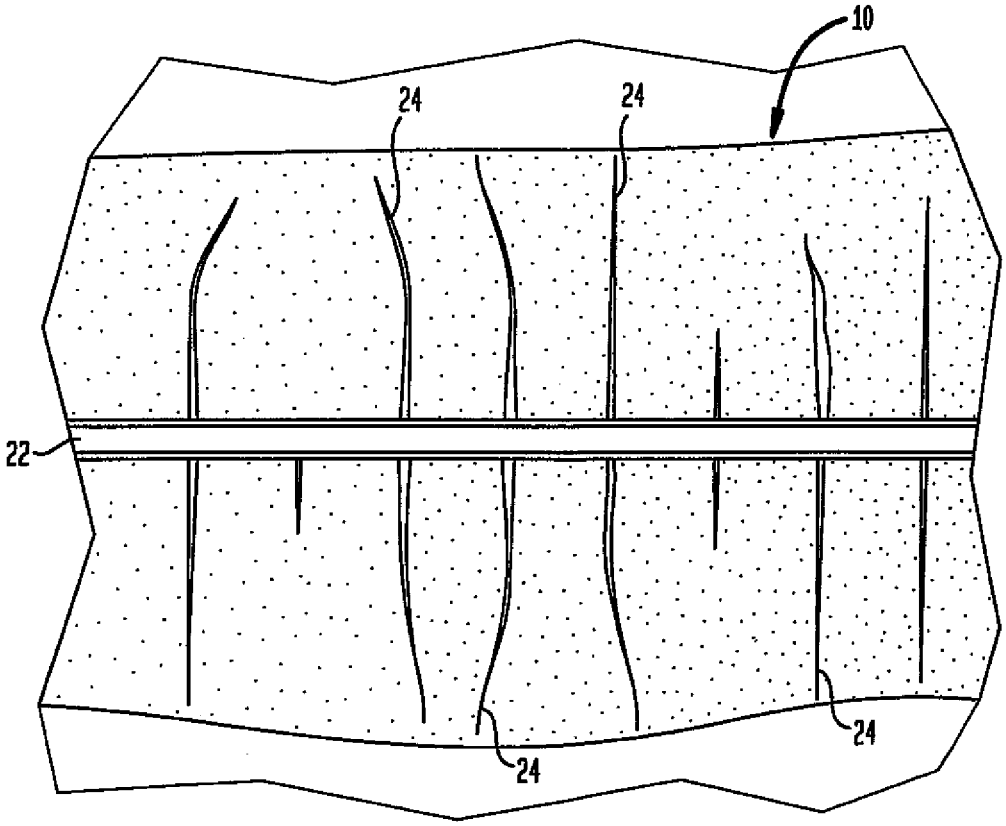
FIG. 2 is an idealized image showing a horizontal section of the pipe of FIG. 1 and the fractures created in the shale matrix by the pressurized fracturing fluid containing proppants.

A perforating gun (not shown) is lowered into horizontal pipe section 22. The gun creates explosions which pierce the horizontal section of the pipe. As illustrated in FIG. 2, the explosions create openings in the pipe such that the fissures or fractures 24 in the shale matrix are in fluid communication with the interior of the pipe.

Fracturing fluid is created by combining water with additives, including sand, ceramic pellets or other base particles, called "proppants" (because the fractures are "propped" open by the base materials which wedge into the fissures) mixed with chemicals. The water and proppants make up about 98% of the fracturing fluid.

The other 2% of the fracturing fluid may include acid, lubricants, gelling agents, pH adjusting agents, substances that delay the breakdown of the gel, iron control substances, corrosion inhibitors, anti-bacterial agents, crosslinking substances, clay stabilizers and/or non-emulsifying agents. The particular chemicals that are added to water and proppants to obtain the fracturing fluid depend upon the specific geology of the site and the preference of the drilling company.

Figure 3:
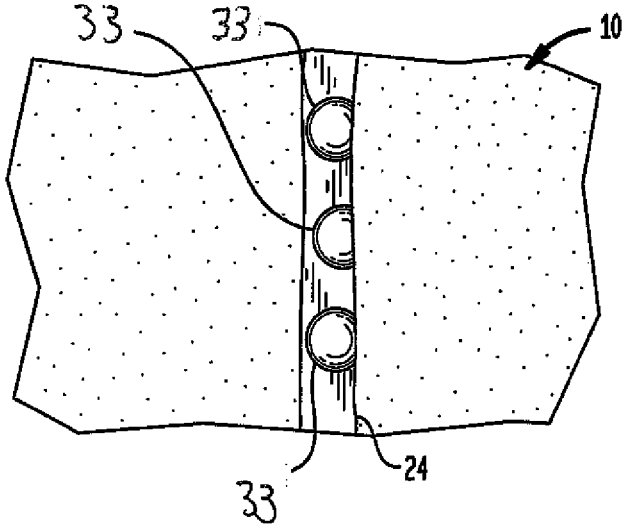
FIG. 3 is an enlarged portion of a shale fracture shown in FIG. 2 with coated proppant lodged therein.

The fracturing fluid including proppants 33 is pumped under high pressure into the pipe and through the pipe openings to widen fractures 24 in the shale formation 10 such that additional amounts of the natural gas or oil trapped in the rock can be released. Between 2 and 7 million gallons of fracturing fluid is required for each well. As shown in FIG. 3, proppants 33 lodge within the fractures 24 and remain in position in the fractures to keep the fractures open.

Natural pressure and pumps cause the fracturing fluid to re-enter the pipe through the openings created in the pipe. About 30% of the fracturing fluid will seep back into the pipe and flow up to the surface where it is collected. That fluid is referred to as wastewater or flowback fluid once it returns to the surface.

The wastewater is toxic, often containing a variety of contaminants including highly corrosive salts, carcinogens, like benzene, and radioactive elements such as radium, uranium, thorium, strontium and cesium. Those contaminants may be at levels several thousand times greater than permitted by drinking water standards. Some of the contaminants occur naturally thousands of feet underground. However, the wastewater also contains toxic substances which were added to the water to form the fracturing fluid. The contaminated wastewater is collected at the surface and stored in tanks or in open pits at the surface until it can be disposed of.

Once the fracturing phase is completed, the drilling rig 14 is removed and the gas or oil recovery phase begins. As the wastewater recedes, sand grains or ceramic pellets which form proppants 33 remain wedged in the rock fractures, keeping the fractures open so that the pressurized gas or oil in the rock can more easily escape. The natural gas or oil flows from the fractures 24 in the shale back through the perforations in the horizontal section 22 of the pipe. The gas or oil rises to the surface through the vertical section 20 of the pipe where it is collected.

The contaminated wastewater may be hauled to sewerage plants for treatment. However, sewerage plants are generally not designed to adequately treat waste with that type or level of contamination. Most sewerage plants are not even required to monitor the level of radioactive substances in the water that they discharge. Ultimately, the wastewater may be discharged into rivers that supply drinking water.

Alternatively, the contaminated wastewater may be hauled to injection wells for subterranean disposal or be temporarily stored in open pits. Whatever disposal method is used, the release into the environment of so much contaminated water, containing unmonitored levels of radioactive materials, is a cause of great concern. The Environment Protection Agency and other federal and state governmental agency scientists are studying the problem and trying to determine the health risks posed by the disposal of such contaminated wastewater.

Figure 4:
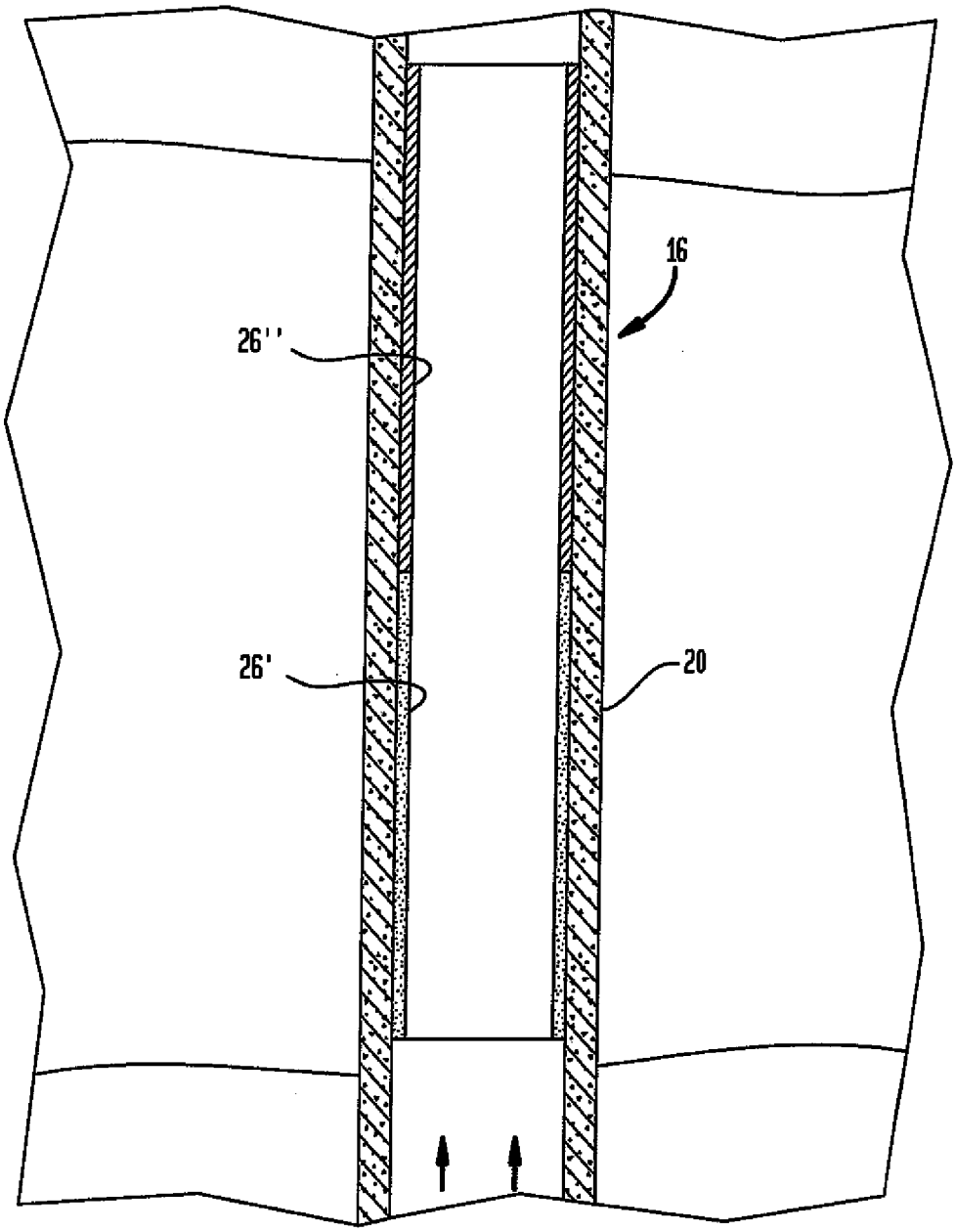
FIG. 4 is a cross-sectional view of a vertical section of the pipe of FIG. 1 showing first and second adjacent contaminant-capturing coated sections.
Figure 5:
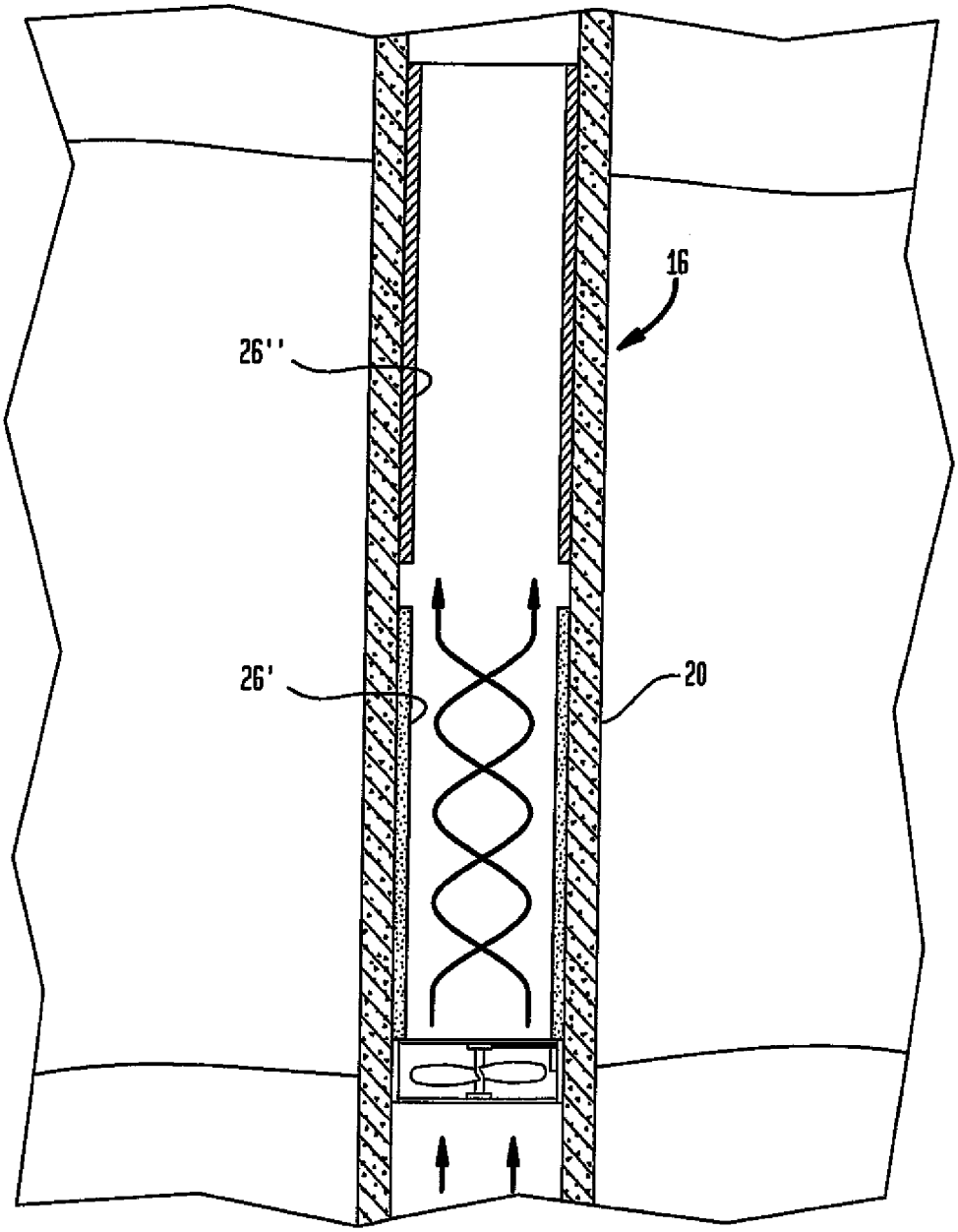
FIG. 5 is a cross-sectional view of a vertical section of the pipe of FIG. 1 showing first and second non-adjacent contaminant-capturing coated sections, one of which is provided with a turbulence inducing propeller.
Figure 6:
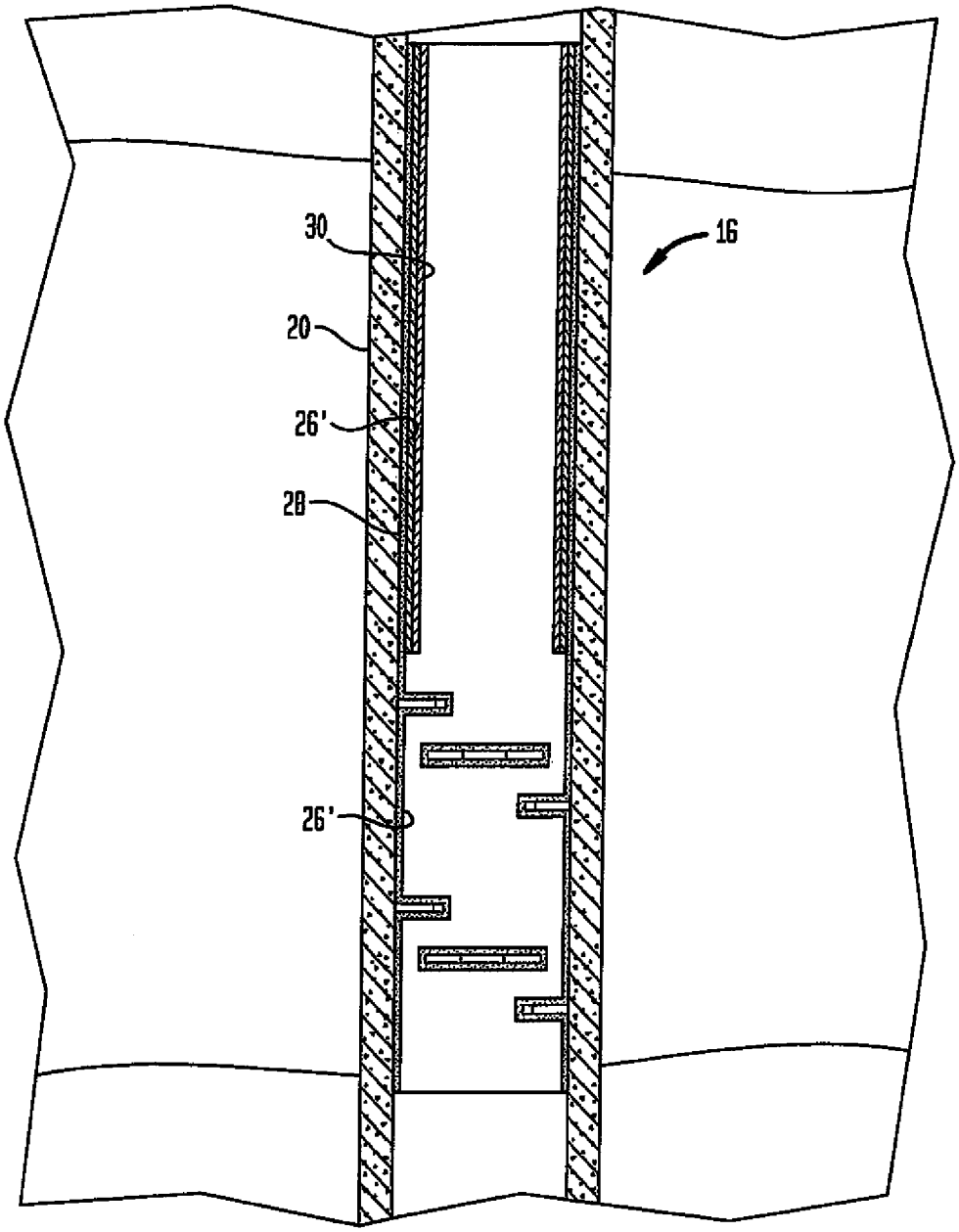
FIG. 6 is a cross-sectional view of a vertical section of the pipe of FIG. 1 showing a contaminant-capturing coated section with a series of turbulence inducing protrusions.

The object of the present invention is to eliminate or at least greatly reduce the contaminants from the wastewater in a simple and relatively inexpensive manner and, at the same time, provide for the permanent underground storage of the removed contaminants, at no additional cost. In one preferred embodiment, the present invention involves creating a coating or sealant 26 on the interior surface of one or more sections of the pipe, preferably the vertical section of the pipe, as illustrated in FIGS. 4, 5 and 6. The coating 26 can be deposited onto the interior surface of the pipe by any method, such as by spraying or brushing the substance onto the interior surface of the pipe. The coating can be applied before or after the pipe sections are situated in the borehole.

The coating 26 consists of a substance capable of capturing the contaminants, including the toxic and radioactive materials, from the wastewater as it flows through the pipe to the surface. The pipe section with coating 26, with the captured contaminants sequestered in the coating, will be left in the ground after the hydrofracking process is complete, where it will remain forever, eliminating the need to dispose of the highly toxic/radioactive captured substances into the environment. In that regard, it is to be noted that governmental regulations permit naturally occurring radioactive materials, sometimes referred to by the acronym NORM, to remain in the ground.

The particular substance from which the coating is formed will depend upon the contaminants to be removed. Further, the composition of the wastewater may change over time depending upon a number of factors requiring additional or different contaminant-capturing substances to be coated onto the interior pipe surface.

Many different products are commercially available for this purpose. Dow Chemical Company sells a variety of fine mesh ion exchange resins under the trademark DOWEX for the removal of particles of different sizes and cross-linkages from fluids. Molycorp Minerals of Greenwood Village, Colo. offers a product under the trademark XSORBX ASP that is suitable for arsenic sequestration. U.S. Pat. No. 4,415,677 teaches using a composite of polymeric zirconium hydrous oxide in a macroporous matrix to remove sulfate ions. Eichrom Technologies LLC of Lisle, Ill. supplies a range of cation and anion exchange resins designed to remove specific substances from fluids. ABSMaterials sells a hybrid organic-inorganic nano-engineered structure designed to remove hydrocarbons from water.

The invention allows for a great deal of flexibility and customization, depending upon the contaminants to be removed and other factors such as engineering or regulatory considerations or process optimization. Selective sections of the pipe 20 may be coated with different substances to create coatings 26' and 26" of different compositions, so as to remove different types of contaminants at different depths. For example, it may be desirable or more efficient to sequester radium using a coating 26' along one section of the pipe 20, for example 6000 to 5,500 feet below grade, and uranium with a different coating 26' along a second section of the pipe, for example 5,500 to 4000 feet below grade. The pipe sections with the different coatings 26' and 26" can be adjacent to each other, as illustrated in FIG. 4, or spaced from each other, as illustrated in FIG. 5.

Moreover, successive coatings of the same or different materials may be used over time in the same pipe section. FIG. 6 illustrates a pipe section with a first coating 26' covered by a second coating 30 of a different material. The second coating 30 may consist of a different contaminant-capturing substance from the contaminant-capturing substance which forms first coating 26' or may consist of an inert substance designed to protect coating 26' from the fracturing fluid during the fracturing portion of the process and be abraded or otherwise removed at a known rate to expose coating 26' during the wastewater collection portion of the process.

In some applications, it may be desirable to increase the surface area of the interior surface of the pipe section to be coated prior to coating the surface of the pipe section with the contaminant-capturing substance. That can be accomplished by depositing a layer 28 of surface area increasing material selected from the following group: nanotubes, nanostructures, roughened matrices, mesh and zeolite on the interior surface of the pipe before applying coating 26', as illustrated in FIG. 6.

Instead of coating the contaminant-capturing substance directly on the interior surface of the pipe section, it may be desirable to create a lining impregnated with a heat-settable resin containing the contaminant-capturing substance. The lining can be placed within the pipe section in the desired location. Thereafter, hot fluid under pressure can pumped into the liner to expand the liner against the interior surface of the pipe and set the resin to form a hardened layer containing the coating material.

Another aspect of the present invention involves using proppants coated with a contaminant-capturing substance, as illustrated in FIG. 3, to sequester the contaminants in the wastewater instead of or in conjunction with the above described pipe coatings. This aspect of the invention is also directed to a method for removing contaminants from wastewater in a hydraulic fracturing process. The method begins by drilling a borehole from the surface to the shale matrix 10. A pipe is then inserted into the borehole and fractures are created in the shale matrix by pumping fracturing fluid formed of water and proppants 33 under pressure into the shale matrix to widen the fractures in the shale. The proppants 33 lodge in the shale fractures 24 to keep the fractures open. The exterior surface of the proppants 33 is coated with a contaminant-capturing substance 36 which sequesters the contaminants from the fracturing fluid before it re-enters the pipe from the shale matrix and moves through the pipe to the surface. Natural gas or oil from the fractured shale then enters the pipe and moves to the surface to be collected.

Banded proppant beds may be used for selective sequestration of well drilling contaminants. In the process of drilling for natural gas and "tight" oil, as well as in other related processes there is an advantage to being able to sequester certain chemicals underground so that they do not unduly contaminate the flowback water or production water.

Often the contaminants are present in very small quantities but can have a very large effect. For example, several grams of radium can radioactively contaminate millions of gallons of flowback or production waters.

Coating pipes and/or proppants with sequestering chemicals is an effective method of dealing with contaminants inherent in the hydraulic fracturing process. However, the effectiveness of the method may be improved by treating the sequestered proppants to target specific chemicals and then pumping fracturing fluid including the treated proppants into the shale matrix a specific order, such that the sequestration process is optimized. This approach also reduces cost by enabling large amounts of conventional proppants (usually sand or glass beads) to be used in the farther ends of the fractures.

Figure 8:
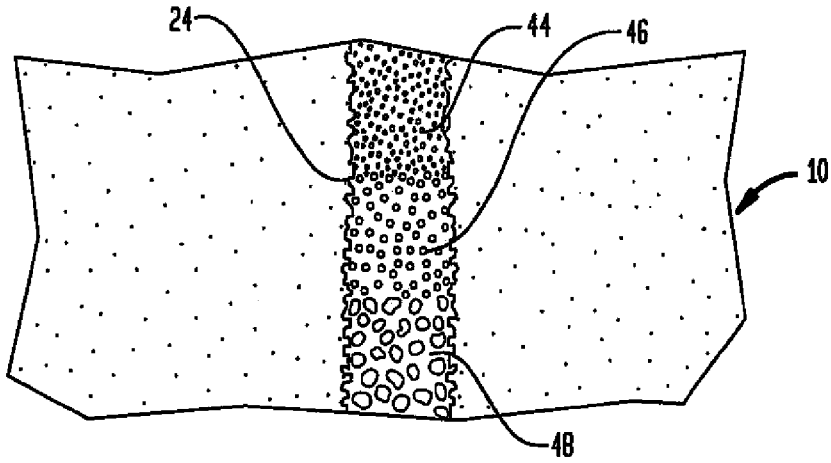
FIG. 8 is a cross-sectional view of a section of shale matrix located above a horizontal section of the pipe having a fracture into which three layers of different type proppants have lodged.

In a typical situation using the layering method, such as illustrated in FIG. 8 which shows a section of the shale matrix 10 located above and spaced from the horizontal section of pipe 22, fracturing fluid containing basic proppants such as sand or glass beads 44, which may be uncoated or may be coated with a non-contaminant-capturing substance such as phenolic resin, is pumped through the pipe such that the proppants 44 migrate towards the most distant portion of the fracture 24 where a layer of the proppants 44 will lodge. After that, fracturing fluid including proppants 46 coated with a sequestering substance such as a barium or a radium sequestering substance for example, is pumped through the pipe and such that proppants 46 lodge in a layer adjacent the layer of proppants 44. After the layer of proppants 46 is formed, another layer of proppants 48, coated with a different sequestering substance such as a barium or radium sequestering substance for example, is pumped through the pipe and forms a third layer adjacent the layer of proppants 46. In this way, deposits of different types of proppants are formed in layers in the fracture 24 of the shale matrix.

An advantage of this layer approach is that the vast bulk of proppants normally do not require coating. As water returns to the HVHF (high volume hydraulic fracturing) pipe, it would in this case first pass through a conventional proppant (sand or glass bead) layer and then a barium sequestration layer, for example. This would keep the barium out of the return water and also make the next layer, for example, a radium sequestration layer, more efficient. Thus, barium would be extracted in one layer and radium in another.

The presence of barium tends to make certain radium and uranium sequestering agents less efficient so this type of "layering" is highly advantageous. Since the quantity of the particular contaminants is small, this process does not interfere with the subsequent flow of gas or oil. In addition, layered beds of this type may be used above ground to selectively filter contaminants in a desired order.

Alternatively, instead of fracturing fluids including proppants 46 and 48 having different sequestering coatings, fracturing fluid formed of a mixture of the pure sequestering substance in liquid or particle form and proppants is be pumped through the pipe after proppants 44, so as to form a layer 50 of a mixture of the sequestering liquid and proppants. After layer 50 is formed, fracturing fluid containing a second layer of proppants 44' is pumped through the pipe and introduced into the fracture to keep the bulk of the sequestering substance in layer 50 in place within the fracture by physical means, thereby creating "striated" beds in the shale matrix, as illustrated in FIG. 9, which shows a section of shale matrix similar to that of FIG. 8.

Other improvements to the basic process are also possible. For example, it is possible to intermix ion exchange resins or other sequestering agents with standard or specialized proppants. Such a process would involve pumping fracturing fluid containing sand or glass bead proppants 44 through the pipe and into the fracture. Thereafter, a fracturing fluid containing sequestering or non-sequestering material 52, alone or mixed with proppants, is pumped through the pipe and into the fracture. That is followed by a fracturing fluid containing a different sequestering or non-sequestering material 54, alone or mixed with proppants, as illustrated in FIG. 10, which shows a section of shale matrix similar to that of FIG. 8.

In the case of certain wells, the TDS (total dissolved solids) in the fluid may come in contact with and be deposited over the sequestering substance lining the pipe or coating the proppants. Those deposited solids tend to disrupt the contaminant-capturing ability of the sequestering substance. In order to avoid that from occurring, the deposited solids may be agitated, for example by pumping compressed air or other gas into the area, so as to create bubbles which disturb the coating of solids or other physically materials and allow the targeted contaminant to come into direct contact with the sequestering substance. In such cases the ionic (or other chemical) bonding should allow more contaminant and less of the deposited solids to be bound. The deposited solids in the waste water can be dealt with after the waste water has reached the surface—through conventional waste treatment means.

Figure 7:
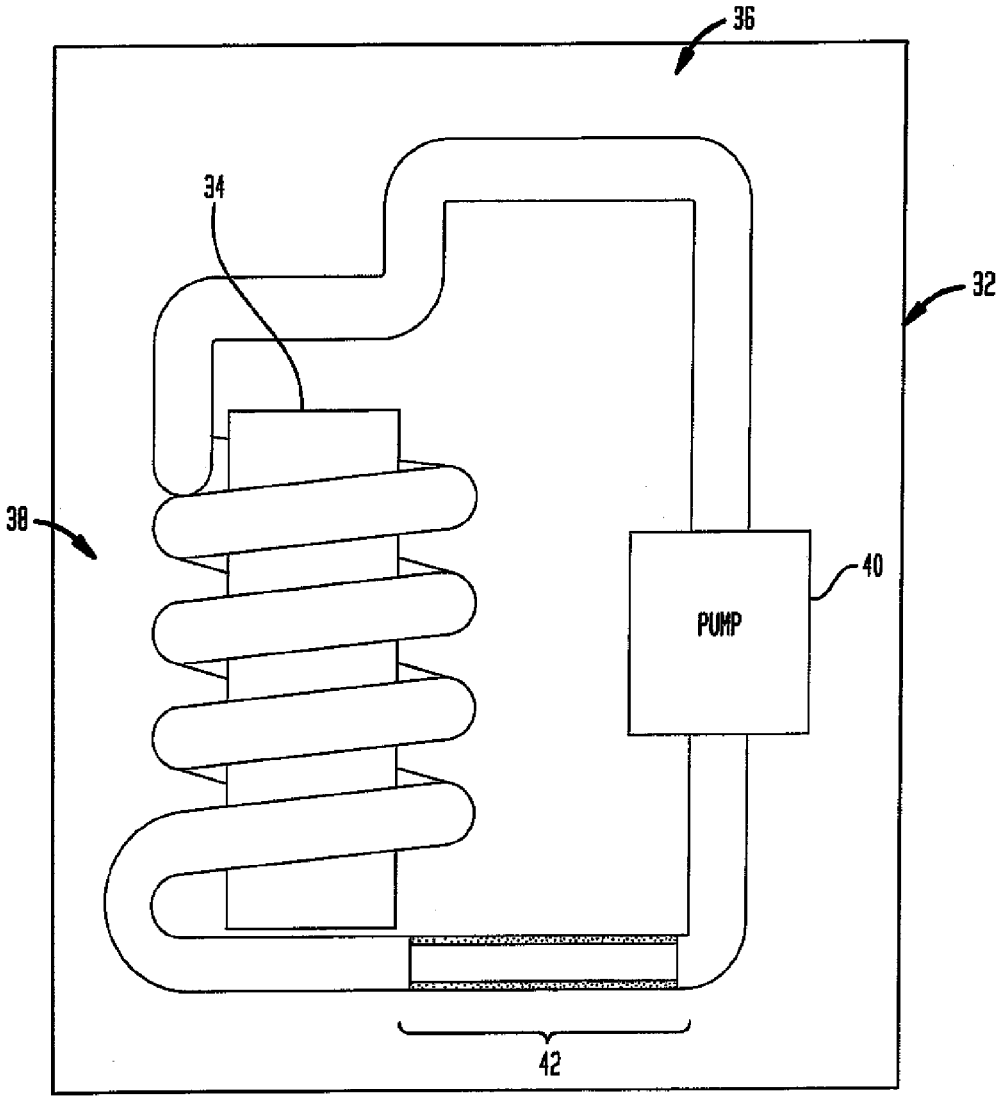
FIG. 7 is an idealized image of a nuclear power plant showing the cooling system including a pipe section with a contaminant-capturing coating in accordance with the present invention.

The present invention also has application outside the hydrofracking process. For example, the methods of the present invention could be used to remove radioactive substances, such as tritium and tritiated water, from the cooling fluid in the cooling system of a nuclear power plant. As illustrated in FIG. 7, which shows an idealized nuclear power plant 32 having a nuclear core 34 cooled by circulating cooling fluid pumped by pump 40 through a coil 38 which surrounds the core 34, the present invention could be used for removing contaminants from the cooling fluid as it circulates through the cooling system of the nuclear reactor. The contaminants from cooling fluid flowing through a pipe section of the cooling system are removed by a coating 42 having a contaminant-capturing substance created on the interior surface of a section of pipe. As the cooling fluid moves through the coated pipe section, the containments are removed. Periodically, the coated pipe section could be removed from the cooling and replaced by a new pipe section. The old section would be buried in a secure facility.

It will now be appreciated that the present invention primarily relates to a method for removing contaminants from wastewater in a hydraulic fracturing process. The method begins by drilling a borehole from the surface to the underground shale matrix. A pipe is inserted into the borehole. Fracturing fluid is pumped under pressure into the shale matrix to widen the fractures in the shale. The interior surface of at least one section of pipe is coated with a contaminant-capturing substance. The pressurized fracturing fluid re-enters the pipe from the shale matrix and moves through the coated pipe section to the surface. Natural gas or oil from the fractured shale enters the pipe and moves to the surface to be collected. The coated pipe section remains in the ground.

The invention also involves coating the exterior surface of the proppants in the fracturing fluid with a contaminant-capturing substance. In this embodiment, the proppants lodge within the fractures formed in the shale matrix. The contaminants are captured by the substance on the exterior surface of the proppants before the fracturing fluid re-enters the pipe. The efficiency of the proppants can be improved by employing proppants of different types, proppants coated with different contaminant-capturing substances, or proppants mixed with contaminant-capturing substances provided in layers in the fracture in the shale matrix. Further, solids deposited over the contaminant-capturing substances can be removed by agitation, such as introduction of compressed air or other gas, in order to improve the efficiency of the contaminant-capturing substances. In all embodiments, the contaminants remain permanently underground, eliminating the waste water disposal problem.

The invention is also usable in non-hydrofracturing applications. For example, the methods of the present invention could be used for removing contaminants from the cooling system of a nuclear power plant. A pipe section of the cooling system is coated with a layer of contaminant-capturing substance, such that contaminants are continuously removed from the cooling fluid as the fluid passes through the coated pipe section. Periodically, the coated pipe section could be removed and disposed of by burying underground.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims.

The invention claimed is:

1. A method for removing contaminants from wastewater in a hydraulic fracturing process comprising the steps of:

drilling a borehole from the surface to the underground shale matrix containing gas or oil;

inserting a pipe into the borehole;

creating openings in the pipe in fluid communication with fractures in the shale matrix;

forming fracturing fluid comprising proppants not coated with a contaminant-capturing substance and pumping the fracturing fluid containing proppants not coated with the contaminant-capturing substance through the pipe and into the shale matrix;

forming fracturing fluid comprising proppants coated with a contaminant-capturing substance and pumping the fracturing fluid containing proppants coated with a contaminant-capturing substance through the pipe and into the shale matrix after pumping the fracturing fluid containing proppants not coated with the contaminant-capturing substance through the pipe and into the shale matrix;

allowing the fluid to re-enter the pipe from the shale matrix and move through the pipe to the surface; and allowing the gas or oil from the fractured shale to enter the pipe and move to the surface to be collected.

2. A method for removing contaminants from wastewater in a hydraulic fracturing process comprising the steps of:

drilling a borehole from the surface to the underground shale matrix containing gas or oil;

inserting a pipe into the borehole;

creating openings in the pipe in fluid communication with fractures in the shale matrix;

forming fracturing fluid comprising proppants not coated with a contaminant-capturing substance;

pumping the fracturing fluid containing the proppants not coated with a contaminant-capturing substance through the pipe and into the shale matrix;

forming proppants coated with a contaminant-capturing substance;

pumping the proppants coated with the contaminant-capturing substance through the pipe and into the shale matrix, wherein the step of pumping fracturing fluid containing proppants not coated with a contaminant-capturing substance through the pipe and into the shale matrix takes place before the step of pumping fracturing fluid containing proppants coated with a contaminant-capturing substance through the pipe and into the shale matrix;

allowing the fluid to re-enter the pipe from the shale matrix and move through the pipe to the surface; and allowing the gas or oil from the fractured shale to enter the pipe and move to the surface to be collected.

3. The method of claim 2 wherein the contaminant-capturing substance comprises a barium sequestering substance.

4. The method of claim 2 further comprising the steps of: forming proppants coated with another contaminant-capturing substance; and pumping the proppants coated with the other contaminant-capturing substance through the pipe and into the shale matrix.

5. The method of claim 4 wherein the other contaminant-capturing substance comprises a radium sequestering substance.

6. The method of claim 4 further comprising the steps of: forming proppants coated with a third contaminant-capturing substance; and pumping the proppants coated with the third contaminant-capturing substance through the pipe and into the shale matrix.

7. A method for removing contaminants from wastewater in a hydraulic fracturing process comprising the steps of:

drilling a borehole from the surface to the underground shale matrix containing gas or oil;

inserting a pipe into the borehole;

creating openings in the pipe in fluid communication with fractures in the shale matrix;

forming fracturing fluids each comprising proppants of different types, at least one of said different proppant types is uncoated;

pumping each of the fluids containing proppants of different types in sequence through the pipe and into the shale matrix such that the proppants of different types lodge in the fractures in the shale in layers;

allowing the fluid to re-enter the pipe from the shale matrix and move through the pipe to the surface; and allowing the gas or oil from the fractured shale to enter the pipe and move to the surface to be collected.

8. The method of claim 7 wherein at least one of said proppant types is coated with a contaminant-capturing substance.

9. A method for removing contaminants from wastewater in a hydraulic fracturing process comprising the steps of:

drilling a borehole from the surface to the underground shale matrix containing gas or oil;

inserting a pipe into the borehole;

creating openings in the pipe in fluid communication with fractures in the shale matrix;

forming fracturing fluid comprising proppants and a contaminant-capturing substance;

pumping the fracturing fluid containing the proppants through the pipe and into the shale matrix such that the proppants lodge in the shale matrix;

pumping a contaminant-capturing substance through the pipe;

pumping fluid containing the proppants through the pipe and into the shale matrix a second time, after the contaminant-capturing substance is pumped through the pipe.

allowing the fluid to re-enter the pipe from the shale matrix and move through the pipe to the surface; and allowing the gas or oil from the fractured shale to enter the pipe and move to the surface to be collected.

10. The method of claim 9 wherein the proppants are uncoated.

11. The method of claim 9 wherein the proppants are coated.

12. The method of claim 11 wherein the proppants are coated with a non-contaminant-capturing substance.

13. A method for removing contaminants from wastewater in a hydraulic fracturing process comprising the steps of:

drilling a borehole from the surface to the underground shale matrix containing gas or oil;

inserting a pipe into the borehole;

creating openings in the pipe in fluid communication with fractures in the shale matrix;

forming fracturing fluid comprising a contaminant-capturing substance;

pumping the fracturing fluid containing the contaminant-capturing substance through the pipe and into the shale matrix such that solids can form on the surface of the contaminant-capturing substance;

removing the solids deposited on the contaminant-capturing substance by agitation;

allowing the fluid to re-enter the pipe from the shale matrix and move through the pipe to the surface; and allowing the gas or oil from the fractured shale to enter the pipe and move to the surface to be collected.

14. The method of claim 13 wherein the step of forming the fracturing fluid includes the step of forming the fracturing fluid including proppants coated with the contaminant-capturing substance.

15. The method of claim 13 wherein the step of removing the deposited solids comprises the step of pumping compressed gas into the pipe.

* * * * *